US008198221B2

(12) United States Patent
Guinther et al.

(10) Patent No.: US 8,198,221 B2
(45) Date of Patent: Jun. 12, 2012

(54) ENGINE WEAR PROTECTION IN ENGINES OPERATED USING ETHANOL-BASED FUEL

(75) Inventors: Gregory H. Guinther, Richmond, VA (US); Roger M. Sheets, Pagosa Springs, CO (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 12/756,738

(22) Filed: Apr. 8, 2010

(65) Prior Publication Data

US 2010/0204073 A1 Aug. 12, 2010

Related U.S. Application Data

(63) Continuation of application No. 11/923,962, filed on Oct. 25, 2007, now Pat. No. 7,737,094.

(51) Int. Cl.
*C10M 159/24* (2006.01)

(52) U.S. Cl. ..... 508/391; 508/392; 508/395

(58) Field of Classification Search ..... 508/391, 508/392, 395
See application file for complete search history.

(56) References Cited

U.S. PATENT DOCUMENTS 5,739,088 A * 4/1998 Inoue et al. ..... 508/156

* cited by examiner

*Primary Examiner* — Walter D Griffin
*Assistant Examiner* — Francis C Campanell
(74) *Attorney, Agent, or Firm* — Luedeka Neely Group, P.C.

(57) ABSTRACT

Lubricant formulations and methods for producing lubricant formulations are described that provide improved wear protection in engines operated using ethanol-based fuels. The improved wear protection may be provided by an increased amount of overbased calcium detergent present in the formulation.

7 Claims, No Drawings

ENGINE WEAR PROTECTION IN ENGINES OPERATED USING ETHANOL-BASED FUEL

This application is a continuation of application Ser. No. 11/923,962, filed Oct. 25, 2007 now U.S. Pat. No. 7,737,094, now allowed.

TECHNICAL FIELD

The present disclosure is related to the field of engine lubricants, and more particularly to lubricant compositions and methods suitable for protecting an engine from wear during the operation of the engine using ethanol-based fuel.

BACKGROUND AND SUMMARY

Increased dependence on imported crude oils, and the rising costs of producing fuels from those oils, has prompted the automotive industry to seek alternative fuel sources for internal combustion engines. One such source is alcohol-based fuels, including ethanol-based fuels. The United States government has offered incentives to automotive manufacturers to produce vehicles capable of operating on ethanol-based fuels, such as E85 fuel, which comprises a blend of about 85% ethanol and about 15% gasoline by volume. However, it has been observed that engines burning ethanol-based fuels, such as fuels containing from about 10 to about 100 percent ethanol, display a significant increase in the wear of engine parts, such as cylinders, rings, and valve train components, relative to engines operated using gasoline. Thus, it would be advantageous to have an engine lubricant that provides improved wear protection to engines operated using ethanol-based fuels.

A first aspect of the present disclosure provides a lubricant composition suitable for lubricating an engine. The lubricant composition includes a base oil and an overbased calcium detergent in an amount effective to reduce engine wear in an engine operated using an ethanol-based fuel.

In another aspect of the present disclosure an additive concentrate for a lubricant is provided. The additive concentrate may include an overbased calcium detergent in an amount effective to reduce engine wear in an engine operated using an ethanol-based fuel when the additive composition is formulated into a lubricant and the engine is lubricated by the lubricant during operation.

Another embodiment of the present disclosure provides a method of reducing engine wear in an engine operated using an ethanol-based fuel. The method includes contacting at least a portion of the engine with a lubricant composition. The lubricant composition may include a base oil and an overbased calcium detergent in an amount effective to reduce engine wear in the engine. The method may further include operating the engine using ethanol-based fuel.

Yet another aspect of the present disclosure provides a method of formulating a wear-reducing lubricant composition suitable for lubricating an engine operated using ethanol-based fuel. The method includes adding to a lubricating oil an amount of overbased calcium detergent such that the overbased calcium detergent in the lubricant composition is about 1.5 times greater than an amount of overbased calcium detergent initially in the lubricating oil.

One of the advantages of the present disclosure is that the use of lubricants as described herein may extend engine life and efficiency in an engine operated using ethanol-based fuel. Another advantage of the present disclosure may provide the vehicle operator the ability to extend the time between oil changes.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EXEMPLARY EMBODIMENTS

The present disclosure will now be described in the more limited aspects of preferred embodiments thereof, including various examples and illustrations of the formulation and use of the present disclosure. It will be understood that these embodiments are presented solely for the purpose of illustrating the invention and shall not be considered as a limitation upon the scope thereof.

As used herein, the terms "alcohol-based fuel" and "ethanol-based fuel" refer to any fuel composition containing from about 10 to about 100 percent by weight of ethanol.

As used herein, the term "hydrocarbyl" refers to a group having a carbon atom attached to the remainder of the molecule and having predominantly hydrocarbon character. Examples of hydrocarbyl groups include:

a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

b) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

c) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Embodiments of the present disclosure may provide improved wear protection to internal combustion engines operated using ethanol-based fuels, including, but not limited to, E85 fuel. Suitable ethanol based fuels compatible with formulations according to the present disclosure may range from about 10 to about 100 percent by weight of ethanol. Likewise, embodiments of the present disclosure may reduce wear in engines operated using ethanol-based fuels.

For the purposes of this disclosure, the phrases "improved wear protection" and "wear reduction" or "reduced wear" mean that the amount of wear accumulated by metal engine parts, such as cylinders, rings, and valve train components, may be reduced in engines lubricated with lubricants according to embodiments of the present disclosure, relative to the amount of wear present in engines lubricated with lubricating oils not in accordance with the present disclosure, when the engines have been operated under otherwise comparable conditions.

It has been found that lubricating an engine with an ILSAC GF-4 lubricating oil formulation modified to include about 1.5 times the amount of overbased calcium detergent otherwise included in a standard GF-4 lubricant formulation significantly and unexpectedly provides improved wear protection for an engine operated using ethanol-based fuel, when compared to an engine operated using ethanol-based fuel and lubricated with an unmodified formulation, i.e. a lubricant having no additional overbased calcium detergent present.

Overbased Calcium Detergents

Certain overbased calcium detergents may be included in the various embodiments of the present invention. A suitable detergent may include an oil-soluble overbased salt of calcium with one or more of the following acidic substances (or mixtures thereof): (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage. Such an organic phosphorus acid may include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

Suitable salts may include overbased salts of calcium. As a further example, suitable salts may include calcium sulfonate or calcium phenate. See, e.g., U.S. Pat. No. 6,482,778.

The term "overbased" in connection with metallic detergents may be used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts such as a calcium sulfonate, a calcium carboxylate, a calcium salicylate, a calcium phenate, a sulfurized calcium phenate. Further examples include a calcium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a calcium salt of an aliphatic carboxylic acid and an aliphatic substituted cycloaliphatic carboxylic acid and many other similar alkali and alkaline earth metal salts of oil-soluble organic acids.

As is well known, overbased metal detergents are generally regarded as containing overbasing quantities of inorganic bases, generally in the form of micro dispersions or colloidal suspensions. Thus the term "oil-soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil. Collectively, the various metallic detergents referred to herein above, are sometimes called basic or overbased calcium organic acid salts.

Methods for the production of oil-soluble neutral and overbased calcium detergents are well known to those skilled in the art, and extensively reported in the patent literature. See, for example, U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; and 4,880,550.

The calcium detergents utilized in this invention can, if desired, be oil-soluble boronated neutral and/or overbased alkali of calcium-containing detergents. Methods for preparing boronated metallic detergents are described in, for example, U.S. Pat. Nos. 3,480,548; 3,679,584; 3,829,381; 3,909,691; 4,965,003; and 4,965,004.

In embodiments of the present disclosure, an overbased calcium detergent having a Total Base Number ("TBN") ranging from about 30 to about 600 may be suitable, and as a further example an overbased calcium detergent having a TBN ranging from about 200 to about 500 may also be suitable.

While any effective amount of the overbased calcium detergents may be used to provide the wear-reducing benefits of this invention, typically these effective amounts will range from about 1.9 to about 4.0 wt. % in the finished fluid, or as a further example, from about 2.2 to about 3.4 wt. % in the finished fluid. In a further embodiment, a lubricating fluid may be top-treated with an amount of overbased calcium detergent effective to improve wear protection in an engine operated using ethanol-based fuel, ranging from about 0.1 to about 2.2 wt. % in the finished fluid, such that the finished fluid contains at least about 1.5 times as much overbased calcium detergent as the initial fluid.

Embodiments of the present disclosure may also include a base oil and one or more additional optional additive components, as described below.

Base Oil Components

Base oils suitable for use in formulating the compositions, additives and concentrates described herein may be selected from any of the synthetic, natural and mineral oils, or mixtures thereof. Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. In an embodiment, the base oil typically has a viscosity of about 2.5 to about 15 cSt. In another embodiment, the base oil has a viscosity of about 2.5 to about 11 cSt at 100° C.

Such base oils include those conventionally employed as crankcase lubricating oils for spark-ignited and compression-ignited internal combustion engines, such as automobile and truck engines, marine and railroad diesel engines, and the like. These base oils are typically classified as Group I, Group II, Group III, Group IV and Group V. The above mentioned base oils are described below in Table 1.

TABLE 1

Group I-V Base Oils

| Base Oil | % Sulfur | | % Saturates | Viscosity Index |
|---|---|---|---|---|
| Group I | >0.03 | and/or | <90 | 80-120 |
| Group II | ≦0.03 | and/or | ≧90 | 80-120 |
| Group III | ≦0.03 | and/or | ≧90 | ≧120 |
| Group IV | * | | | |
| Group V | ** | | | |

* Group IV base oils are defined as all polyalphaolefins

** Group V base oils are defined as all other base oils not included in Groups I, II, III and IV and may include gas to liquid base oils.

The optional additive components may typically be blended into the base oil in an amount that enables that additive to provide its desired function. Representative effective amounts of the various additives, when used in crankcase lubricants, are listed in Table 2 below. All the values listed are stated as weight percent of the finished fluid of active ingredient.

TABLE 2

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.1-6.0 | 0.1-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

Lubricant compositions made with the overbased calcium detergent described herein are useful in a wide variety of applications. For engines operated using ethanol-based fuel, it is preferred that the lubricant compositions meet or exceed published GF-3, GF-4, proposed GF-5, or the next "S" category API standards. Lubricant compositions according to the foregoing GF-3, GF-4, proposed GF-5, or the next "S" category API standards include a base oil, and overbased calcium detergent, and an additive composition comprising an effective amount of one or more of the additives listed in Table 2.

Dispersant Components

Dispersants contained in the additive composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors, or antioxidants, reduce the tendency of base stocks to deteriorate in service, which deterioration can be evidenced by the products of oxidation such as sludge and varnish-like deposits that deposit on metal surfaces and by viscosity growth of the finished lubricant. Such oxidation inhibitors include, but are not limited to, hindered phenols, sulfurized hindered phenols, alkaline earth metal salts of alkylphenolthioesters having about $C_5$ to about $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and diarylamines, alkylated phenothiazines, sulfurized compounds, and ashless dialkyldithiocarbamates. Non-limiting examples of sterically hindered phenols include those described in U.S Publication No. 2004/0266630.

Diarylamine antioxidants include, but are not limited, to diarylamines having the formula:

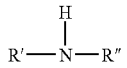

wherein R' and R" each independently represents a substituted or unsubstituted aryl group having from about 6 to about 30 carbon atoms. Illustrative of substituents for the aryl group include, but are not limited to, aliphatic hydrocarbon groups such as alkyl group having from about 1 to about 30 carbon atoms, hydroxy groups, halogen radicals, carboxylic acid or ester groups, or nitro groups.

Another class of aminic antioxidants includes phenothiazine or alkylated phenothiazine having the chemical formula:

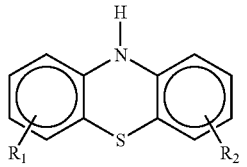

wherein $R_1$ is a linear or branched about $C_1$ to about $C_{24}$ alkyl, aryl, heteroalkyl or alkylaryl group and $R_2$ is hydrogen or a linear or branched about $C_1$- about $C_{24}$ alkyl, heteroalkyl, or alkylaryl group.

The sulfur containing antioxidants include, but are not limited to, sulfurized olefins that are characterized by the type of olefin used in their production and the final sulfur content of the antioxidant. The foregoing aminic, phenothiazine, and sulfur containing antioxidants are described, for example, in U.S. Pat. No. 6,599,865.

Non-limiting examples of dialkyldithiocarbamates that may be used as antioxidants are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Organomolybdenum containing compounds used as friction modifiers may also exhibit antioxidant and antiwear functionality. U.S. Pat. No. 6,797,677 describes a combination of organomolybdenum compound, alkylphenothizine and alkyldiphenylamines for use in finished lubricant formulations. Non-limiting examples of suitable molybdenum containing friction modifiers are described below under "Friction Modifier Components".

The overbased calcium detergents described herein may be used with any or all of the foregoing antioxidants in any and all combinations and ratios. It is understood that various combinations of phenolic, aminic, sulfur containing and molybdenum containing additives may be optimized for the finished lubricant formulation based on bench or engine tests or modifications of the dispersant, VI improver, base oil, or any other additive.

Friction Modifier Components

A sulfur- and phosphorus-free organomolybdenum compound may be used as a friction modifier. Non-limiting examples of sulfur- and phosphorus-free organomolybdenum compounds include compounds described in U.S. Pat. Nos. 4,259,195; 4,261,843; 4,164,473; 4,266,945; 4,889,647; 5,137,647; 4,692,256; 5,412,130; 6,509,303; 6,528,463; and 4,889,647.

Examples of sulfur-containing organomolybdenum compounds appearing in patents and patent applications include compounds described in U.S. Pat. Nos. 3,509,051; 3,356,702; 4,098,705; 4,178,258; 4,263,152; 4,265,773; 4,272,387; 4,285,822; 4,369,119; 4,395,343; 4,283,295; 4,362,633; 4,402,840; 4,466,901; 4,765,918; 4,966,719; 4,978,464; 4,990,271; 4,995,996; 6,232,276; 6,103,674; and 6,117,826.

Glycerides may also be used alone or in combination with other friction modifiers. Suitable glycerides include, but are not limited to, glycerides of the formula:

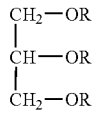

wherein each R is independently selected from the group consisting of H and C(O)R' where R' may be a saturated or an unsaturated alkyl group having from about 3 to about 23 carbon atoms.

Other Components

Rust inhibitors selected from the group consisting essentially of nonionic polyoxyalkylene polyols and esters thereof, polyoxyalkylene phenols, and anionic alkyl sulfonic acids may be used.

A small amount of a demulsifying component may be used. A preferred demulsifying component is described in EP Pat. No. 330,522, the disclosure of which is herein incorporated by reference. Such demulsifying component may be obtained by reacting an alkylene oxide with an adduct obtained by reacting a bis-epoxide with a polyhydric alcohol. The demulsifier should be used at a level not exceeding 0.1 mass % active ingredient. In an embodiment, a treat rate of about 0.001 to about 0.05 mass % active ingredient may be used.

Pour point depressants, otherwise known as lube oil flow improvers, lower the minimum temperature at which the fluid will flow or can be poured. Such additives are well known. Non-limiting examples of pour point depressant additives which improve the low temperature fluidity of the fluid are about $C_8$ to about $C_{18}$ dialkyl fumarate/vinyl acetate copolymers, polyalkylmethacrylates, polystyrenesuccinate esters, and the like.

Foam control may be provided by many compounds including, but not limited to, an antifoamant of the polysiloxane type, for example, silicone oil or polydimethyl siloxane.

Seal swell agents, as described, but not limited to, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Non-limiting examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may also be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The overbased calcium detergent may be added directly to the lubricating oil composition. In one embodiment, however, the overbased calcium detergent may be diluted with a substantially inert, normally liquid organic diluent such as mineral oil, synthetic oil, naphtha, alkylated (e.g. $C_{10}$ to $C_{13}$ alkyl)benzene, toluene or xylene to form an additive composition concentrate. These concentrates may usually contain from about 1% to about 100% by weight and in one embodiment about 10% to about 90% by weight of an overbased calcium detergent having a suitable TBN as described herein.

The following example is given for the purpose of exemplifying aspects of the embodiments and is not intended to limit the embodiments in any way.

EXAMPLE

Test fluids A, B, and C were formulated for the purpose of evaluating lubricant performance in an engine operated using an ethanol-based fuel. Test fluid A was an unmodified factory fill GF-4 lubricant formulation. Test fluid B was prepared with 1.5 times the amount of overbased calcium detergent in fluid A, but was otherwise identical to fluid A. Test fluid C was prepared by substituting an overbased magnesium detergent for the calcium detergent, to have about the same TBN as fluid B, but otherwise was identical to fluid A.

In this example, the formulation of fluid B had about 2.8 wt % of calcium sulfonate and a TBN of about 300, while the formulation of fluid C had about 2.1 wt % of magnesium sulfonate and a TBN of about 400. The control fluid, fluid A, had a calcium sulfonate concentration of about 1.5 to 1.8 wt %.

TABLE 3

| Engine Wear Measurement | | | |
|---|---|---|---|
| Measurement | Fluid A | Fluid B | Fluid C |
| Fuel | E85 | E85 | E85 |
| Roller Follower Pin, μm, avg | 13.0 | 3.1 | 5.0 |
| Top Ring Gap Increase, μm, avg | 137.0 | 117.0 | 152.0 |
| Top Ring Gap Increase, μm, MAX | 178.0 | 127.0 | 254.0 |

Table 3, above, displays the results of wear tests on the three fluids. All three fluids were tested in an engine operated using E85 ethanol-based fuel. As shown in the results, fluid B exhibited the least amount of wear on the roller follower pins and top rings. Fluid C, with the magnesium detergent, did not perform as well as fluid B, with the calcium detergent. Fluid A, the unmodified lubricant, exhibited the most wear of the fluids tested. As shown in table 3, a lubricant having an increased amount of overbased calcium detergent may exhibit superior wear protection in an engine operated using an ethanol-based fuel.

In a further test, used lubricant test fluids A, B, and C were subjected to elemental analysis to determine metal content after use. Table 4, below, shows the results of this analysis. Notably, the reduced amount of iron present in used fluid B correlates with the wear protection properties exhibited by embodiments of the present disclosure. Conversely, the relatively higher concentrations of iron in fluids A and C may be due to greater wear of the parts during engine operation.

TABLE 4

| Used Oil Analysis, ppm | | | |
|---|---|---|---|
| Element | Fluid A | Fluid B | Fluid C |
| Fe | 1440 | 413 | 798 |
| Al | 55 | 21 | 36 |
| Cu | 93 | 70 | 56 |
| Pb | 3 | 6 | 0 |
| Ni | 146 | 47 | 51 |
| Sn | 39 | 36 | 37 |

At numerous places throughout this specification, reference has been made to a number of U.S. patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method of reducing engine wear in an engine operating on an ethanol-containing fuel, comprising:

top-treating a lubricant composition comprising a base oil with an amount of non-borated overbased calcium detergent that is effective to reduce engine wear in the engine; and operating the engine using a fuel containing from about 10 to about 100 volume percent ethanol, wherein the top-treated amount of detergent ranges from about 0.1 to about 2.2 percent by weight based on a total weight of the lubricant composition.

2. The method of claim 1, wherein a total amount of detergent in the lubricant composition ranges from above about 1.9 to about 4.0% by weight of the total weight of the lubricant composition.

3. The method of claim 1, wherein the non-borated overbased calcium detergent comprises an overbased calcium salt of a compound selected from the group consisting of sulfonic acids, carboxylic acids, salicylic acids, alkyl phenols, sulfurized alkyl phenols, organic phosphorus acids, and combinations thereof.

4. The method of claim 1, wherein the overbased calcium detergent has a Total Base Number (TBN) ranging from about 30 to about 600.

5. The method of claim 1, wherein the non-borated overbased calcium detergent has a Total Base Number (TBN) ranging from about 200 to about 500.

6. The method of claim 1, wherein the lubricating oil comprises a lubricating oil selected from the group consisting of GF-3 lubricating oils, GF-4 lubricating oils, and GF-5 lubricating oils.

7. The method of claim 1, wherein a total amount of detergent in the lubricant composition ranges from above about 2.2 to about 3.4% by weight of the total weight of the lubricant composition.

* * * * *